United States Patent [19]

Clausin

[11] Patent Number: 4,930,434

[45] Date of Patent: Jun. 5, 1990

[54] IMPROVED SAIL REDUCING WINDER

[75] Inventor: Pierre Clausin, Ville d'Avray, France

[73] Assignee: Proengin S.A., France

[21] Appl. No.: 298,152

[22] Filed: Jan. 17, 1989

[30] Foreign Application Priority Data

Jan. 20, 1988 [FR] France ..... 88 0593

[51] Int. Cl.[5] ..... B63H 9/10

[52] U.S. Cl. ..... 114/106; 114/107

[58] Field of Search ..... 114/102, 104, 105, 106, 114/107, 108

[56] References Cited

FOREIGN PATENT DOCUMENTS 2551722 3/1985 France ..... 114/106

2603551 3/1988 France ..... 114/106

*Primary Examiner*—Sherman D. Basinger

*Attorney, Agent, or Firm*—William A. Drucker

[57] ABSTRACT

A sail reducing winder is provided comprising a rotary tube parallel to the longitudinal axis of the mast as well as a device for holding this tube in position, which has at least two curved wings joined together by one of their ends by a connecting element able to be mounted on the mast, these two wings partially surrounding the tube and having, opposite the connecting element, two respective end edges extending parallel to the tube and defining an axial passage zone for the sail, the wings being offset axially so that their end edges are axially spaced apart from each other by a given distance.

10 Claims, 1 Drawing Sheet

IMPROVED SAIL REDUCING WINDER

BACKGROUND OF THE INVENTION

The present invention relates to an improvement to sail reducing winders and, in particular but not exclusively, to mainsail winders by means of which shortening of the sail takes place by winding the sail on a rotary tube which extends parallel to the longitudinal axis of the mast externally thereof.

One of the problems raised by this type of winder is that the tension of the sail causes bending of the tube which, in addition to the fact that it is prejudicial to the performance of the sail, causes a compression stress on the mast. Furthermore, when the boat is tossed in the sea, the tube begins to oscillate between its two end fixing points and strikes against the mast.

To overcome this problem, it has then been proposed to hold the rotary tube parallel to the mast, by means of "crescents", i.e. by means of elements, e.g. of cylindrical shape, mounted on the mast and which partially surround the tube while defining an axial slit for passage of the sail.

However, this solution which is described in the French patent application 83 14503, filed on 9th September 1983 in the name of the Applicant, suffers from a serious drawback. In fact, under the effect of the forces exerted by the wind, the sail is permanently deformed and thus loses its properties of flatness under tension.

Thus, when it is wound up, it puckers around the rotary tube. It can then be observed, during unwinding which usually takes place through a tractive force exerted on the lower rear corner of the sail, that the puckers during unwinding are frequently dragged into the slit of the crescents and cause jamming of the sail which can then no longer be either let out or hauled in.

The purpose of the invention is then in particular to overcome these drawbacks.

SUMMARY OF THE INVENTION

For this, it proposes using at least one device for holding the tube in position, comprising, in a way similar to said crescents, at least two curved wings, joined together by one of their ends, by means of a connecting element able to be mounted on the mast, these two wings extending respectively on each side of the tube, so as to surround it partially and having, opposite the connecting element, two respective end edges extending parallel to the tube and defining an axial passage zone through which the sail may pass.

According to the invention, this device is more particularly characterized in that said wings are axially offset with respect to each other, so that said end edges are axially spaced apart from each other by a given distance.

Advantageously, the lower side edges of said wings will extend obliquely with respect to the axis of the tube so as to guide the sail to said passage zone.

In a first embodiment of the invention, said holding device is formed from a metal sheet curved so as to have a tubular shape centred on said tube, said connecting element then consisting of a gutter shaped shell from which said wings extend.

In a preferred embodiment of the invention, the tube holding device comprises three wings disposed in a staggered arrangement, namely : two wings extending on the same side of the tube and a third wing situated on the opposite side, whose end edge is situated in line with the gap between the first two wings, at a given axial distance from the end edges of these first two wings.

To allow orientation of the sail on each side of the ship, the above described tube holding devices may be mounted on the mast by means of a swivel device comprising at least one pivoting arrangement with axis parallel to the mast.

BRIEF DESCRIPTION OF THE DRAWINGS

One embodiment of the invention will be described hereafter by way of non limitative example, with reference to the accompanying drawings in which.

DESCRIPTION OF THE PREFERRED EMBODIMENTS

Figure 1:
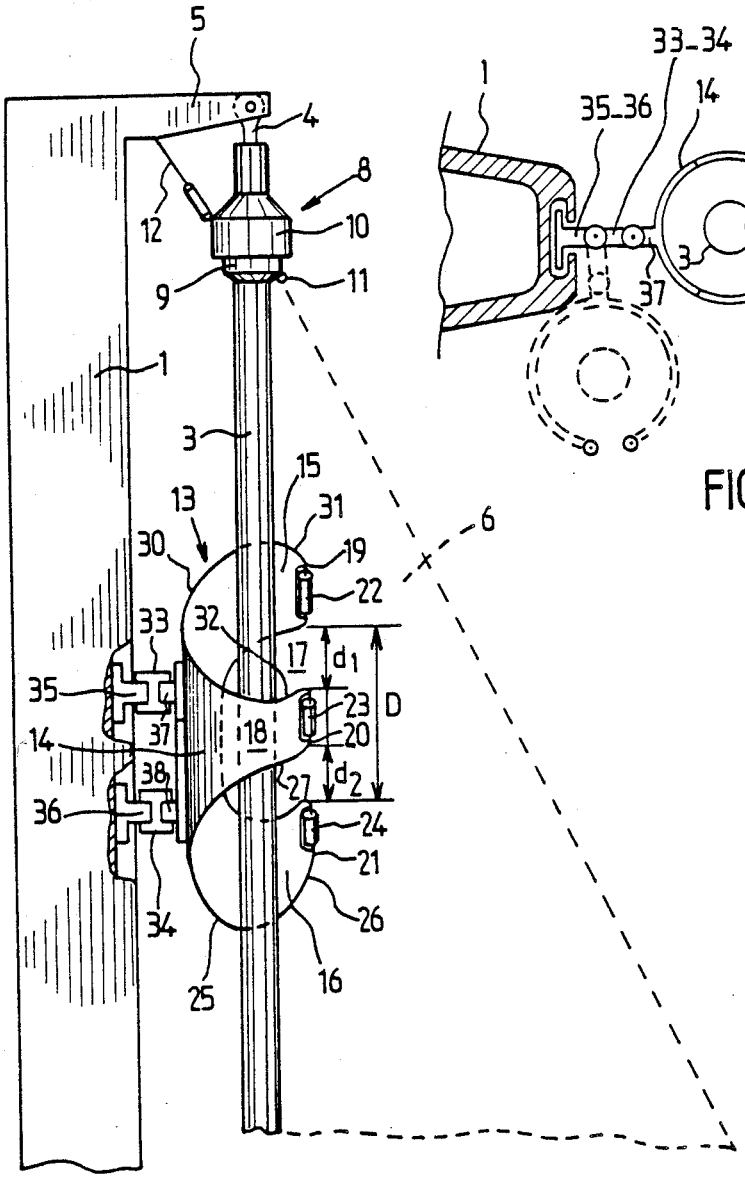
FIG. 1 shows schematically in perspective, a device for holding the tube of a mainsail winder mounted on a mast.

In the example illustrated in FIG. 1, only the upper part of the mast 1 of a boat has been shown, provided with a sail winder whose rotary tube 3 extends parallel to the longitudinal axis of mast 1, slightly at a distance therefrom.

More precisely, this rotary tube 3 is mounted for rotation about a carrier cable 4 stretched between a bracket 5 situated at the mast head and a support piece not shown) fixed towards the lower part of said mast 1.

This tube 3 comprises a longitudinal groove in which the bolt rope of sail 6 shown with broken lines) is engaged and may slide.

Furthermore, on tube 3 a swivel 8 is slidingly mounted whose inner part 9 is attached to the head 11 of sail 6, whereas the external part 10 which pivots freely on the inner part 9 is connected to a halyard 12 passing over a sheave provided in bracket 5. This swivel 8/halyard 12 assembly serves for hoisting sail 6.

Tube 3, parallel to the axis of mast 1, is held in position by a tube holding device of the invention which comprises a holding piece 13 formed from a metal sheet curved so as to have an open tubular shape substantially coaxial with the tube. More precisely, this holding piece 13 comprises, in its part oriented towards the mast, a shell 14 in the shape of a gutter whose two longitudinal edges are extended by three curved wings, namely:

two wings 15, 16 situated respectively in the two end regions of one of the longitudinal edges of shell 14, defining therebetween a free space 17 of given width D, and a wing 18 which extends from the central region of the other longitudinal edge of shell 14, in line with the space 17 between wings 15 and 16.

To minimize the friction which they generate on sail 6, the front edges 19, 20, 21 of wings 15, 18, 16, which extend parallel to the mast 1 are provided with rollers 22, 23, 24.

Figure 2:
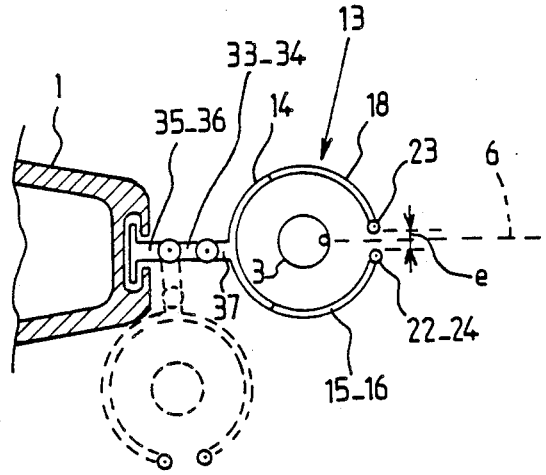
FIG. 2 is a top view of the tube holding device shown in FIG. 1, mounted on a mast shown partially in cross section.

As can be seen in FIG. 2, rollers 22 and 24 define, in vertical projection with roller 23, a space e of appropriate width for facilitating the passage of sail 6, but yet sufficiently small to retain tube 3. These front edges 19, 20, 21 are further spaced axially apart from each other by a distance $d_1$, $d_2$ which is sufficient to let pass the folded portions of sail 6 when it is unwound.

Furthermore, to eliminate any risk of catching and/or jamming of sail 6, the lower edge 25 of shell 14 and the lower side edges 26, 27 of wings 16 and 18 are shaped so as to have a continuous helical form passing around tube 3 and connecting together the lower ends of the front edges 20, 21 of wings 18, 16.

Similarly, for similar reasons, the upper edge 30 of shell 14 and the upper side edges 31, 32 of wings 15 and 18 have a continuous helical shape connecting together the upper ends of the front edges 19, 20 of wings 15 and 18.

The pitch of this helical shape may then be less than that of the shape formed by the lower edges 25, 26, 27.

The holding piece 13 is mounted on mast 1 by means of a swivel device comprising two swivel elements each having a link 33, 34 mounted for swivelling at its ends, on the one hand to a support piece 35, 36 fixed to the mast and, on the other hand, to a swivel piece 37, 38 fixed to the shell, the axes of this double swivel then being parallel to the axis of the mast 1.

The advantage of such an arrangement is that it increases the angular movement of the holding piece 13 and prevents it from abutting against mast 1 under sailing trim running of the boat.

This advantage is illustrated in FIG. 2 in which the holding piece 13 has been shown with broken lines in the endmost left TM hand position.

Of course, the holding piece will be designed so as to define an inner volume with a sufficient section to allow the swivel 8 to pass.

What is claimed is:

1. Sail reducing winder, of the type in which the reduction of said sail takes place by winding the sail on a rotary tube which extends parallel to the longitudinal axis of the mast, this winder comprising at least one device for holding the rotary tube in position parallel to the mast, which comprises at least two curved wings, joined together by one of their ends, by means of a connecting element able to be mounted on the mast, these two wings extending respectively on each side of the tube, so as to surround it partially and having, opposite the connecting element, two respective end edges extending parallel to the tube and defining an axial passage zone through which the sail may pass, where said wings are axially offset with respect to each other, so that said end edges are axially spaced apart from each other by a given distance.

2. The reducing winder as claimed in claim 1, wherein said wings have lower side edges which extend obliquely with respect to the axis of the tube so as to guide the sail to said passage zone.

3. The reducing winder as claimed in claim 1, wherein said holding device is formed from a metal sheet curved so as to have a tubular shape centred on said tube, said connecting element then consisting of a gutter shaped shell from which said wings extend.

4. The reducing winder as claimed in claim 3, wherein said wings have lower side edges and the shell has a lower edge, said lower side edges and said lower edge being formed so as to have a continuous helical shape passing around the tube and connecting together the lower ends of the end edges of said wings.

5. The reducing winder as claimed in claim 1, wherein said end edges are provided with rollers with axis parallel to the mast.

6. The reducing winder as claimed in claim 1, wherein said tube holding device comprises three wings disposed in a staggered arrangement, namely: first and second wings extending on the same side of the tube, said second wing being lower than said first wing, and a third wing situated on the other side of said tube, the end edge of this third wing extending in line with the gap between the first two wings, at a given axial distance from the end edges of the first two wings.

7. The reducing winder as claimed in claim 6, in which said tube holding device is formed from a metal sheet curved so as to have a tubular shape centered on said tube and a part of which, forming a gutter shaped shell, serves as connecting element from which the three wings extend, wherein said third wing and said second wing have lower side edges which form with the lower edge of the shell, a continuous helical shape.

8. The reducing winder as claimed in claim 7, wherein said third wing and the highest of said other two wings have upper side edges and form, with the upper edge of the shell, a continuous helical shape.

9. The reducing winder as claimed in claim 8, wherein the pitch of the helical shape formed by said upper edges is less than the pitch of the helical shape formed by said lower edges.

10. The reducing winder as claimed in claim 1, wherein said connecting element is mounted for pivoting on the mast by means of a swivel device with axis parallel to the mast.

* * * * *